US006172033B1

(12) United States Patent
Goovaerts et al.

(10) Patent No.: US 6,172,033 B1
(45) Date of Patent: Jan. 9, 2001

(54) PROCESS FOR CONDITIONING OF SURFACTANT PASTES TO FORM HIGH ACTIVE SURFACTANT AGGLOMERATES

(75) Inventors: Lucas Goovaerts, Haacht; Liben Hailu, Woluwe St. Lambert, both of (BE)

(73) Assignee: The Procter & Gamble Company, Cincinnati, OH (US)

( * ) Notice: Under 35 U.S.C. 154(b), the term of this patent shall be extended for 0 days.

(21) Appl. No.: 09/214,328

(22) PCT Filed: Jun. 27, 1997

(86) PCT No.: PCT/US97/11282

§ 371 Date: Jan. 4, 1999

§ 102(e) Date: Jan. 4, 1999

(87) PCT Pub. No.: WO98/01529

PCT Pub. Date: Jan. 15, 1998

(30) Foreign Application Priority Data

Jul. 4, 1996 (EP) ..... 96201855

(51) Int. Cl.[7] ..... C11D 11/00

(52) U.S. Cl. ..... 510/444; 510/357; 510/451; 510/495; 264/117; 264/140

(58) Field of Search ..... 510/444, 451, 510/357, 495; 264/117, 140

(56) References Cited

U.S. PATENT DOCUMENTS

| | | | | |
|---|---|---|---|---|
| 5,494,599 | | 2/1996 | Goovaerts et al. | 252/89.1 |
| 5,529,710 | | 6/1996 | Van Dijk et al. | 252/89.1 |
| 5,529,722 | | 6/1996 | Aouad et al. | 252/550 |
| 5,698,510 | * | 12/1997 | Wilkinson et al. | 510/444 |
| 5,955,418 | * | 9/1999 | Kazuta et al. | 510/451 |

FOREIGN PATENT DOCUMENTS

| | | | |
|---|---|---|---|
| 0 508 543 A1 | 10/1992 | (EP) | C11D/17/06 |
| 2 221 695 | 2/1990 | (GB) | C11D/11/00 |
| 93/25378 | 12/1993 | (WO) | B29C/67/02 |
| 98/01529 | 1/1998 | (WO) | C11D/11/00 |

* cited by examiner

*Primary Examiner*—Lorna M. Douyon
(74) *Attorney, Agent, or Firm*—Marianne Dressman; Kim William Zerby; Steven W. Miller

(57) ABSTRACT

A process for conditioning pastes comprising at least 40% by weight of anionic surfactant is provided. The paste is conditioned by mixing alkyl sulphate powder with the surfactant paste in a ratio of at least 1 part powder to 100 parts paste. This conditioning step increases the viscosity of the surfactant paste. The conditioned paste is processed into agglomerates by granulating with builder powders wherein the ratio of high viscosity paste to builder powder is from 9:1 to 1:5. This process enables detergent agglomerates with high surfactant activity to be formed.

6 Claims, No Drawings

PROCESS FOR CONDITIONING OF SURFACTANT PASTES TO FORM HIGH ACTIVE SURFACTANT AGGLOMERATES

The invention relates to a process for making a granular detergent component or composition.

Manufacturing processes are known wherein granular detergent products are made by forming a neutral or alkaline paste comprising at least 40% by weight of anionic surfactant; and mixing the high viscosity paste so-formed with builder powders wherein the ratio of high viscosity paste to builder powder is from 9:1 to 1:5 to form the granular detergent component or composition. Such processes are commonly called agglomeration processes EP-A-0 663 439, published on Jul. 19, 1995, and EP-A-0 508 543, published on Oct. 14, 1992, both describe enhanced embodiments of agglomeration processes which includes a process of surfactant paste conditioning in, for example, a twin-screw extruder, followed by granulation in a high shear mixer.

EP-A-0 508 543 mentions the possibility to add anionic surfactant into the process via a powder stream. However it is not specified whether this powder stream is added into the extruder, or into the high-shear mixer. Neither of these publications describes the use of dry alkyl sulphate powder in the conditioning step.

The object of the present invention is to provide an effective process for conditioning pastes comprising at least 40% by weight of anionic surfactant. The conditioning agent disrupts surfactant crystallinity, and also increases the viscoelasticity of the paste. The crystalline disruption improves rate of surfactant solubility, whilst the viscoelasticity increase "conditions" the paste enabling agglomerates with high surfactant activity to be formed. The paste is processed into agglomerates by granulating with builder powders wherein the ratio of high viscosity paste to builder powder is from 9:1 to 1:5.

SUMMARY OF THE INVENTION

The object is achieved by mixing a first powder with the surfactant paste in a ratio of at least 1 part powder to 100 parts paste, the first powder comprising at least 80% by weight of alkyl sulphate, and whereby the mixing step increases the viscosity of the surfactant paste.

In a preferred embodiment of the invention, alkyl sulphate powder, comprising less than 5% by weight of water, is mixed with other surfactants in the paste in an extruder. In an even more preferred embodiment of the invention the paste and alkyl sulphate powder mixture is carried out sequentially in a high-shear mixer granulator having a tool tip-speed of from 5 to 50 m/sec, and a medium speed agglomerator.

Most preferred builder powders are carbonate, aluminosilicate and silicate.

DETAILED DESCRIPTION OF THE INVENTION

The present invention concerns conditioning of anionic surfactant in an aqueous, highly concentrated solution of its salt, preferably its sodium salt. These high active, low moisture surfactant pastes are of a high viscosity but remain pumpable at temperatures at which the surfactants are stable. In other processes, anionic surfactants or mixtures comprising at least one anionic surfactant, where highly viscous liquid crystal phases occur, requires that either lower viscous crystal phases be formed or that some viscosity modifiers are used. This requires expensive additives, and prevents high surfactant activities from being achieved.

Conditioning of a paste means the modifying of its physical characteristics to form higher active, less sticky agglomerates which are not easily obtainable under normal operating conditions. Conditioning of the paste as defined herein, means: a) increasing its apparent viscosity, b) increasing its effective melting point, c) increasing the "hardness" of the paste. The hardness/softness of the paste may be measured by a softness penetrometer according to ASTM D 217-IP50 or ISO 2137. The hardness of conditioned paste measured in this way should be less than 2cm, preferably less than 1cm.

Chemical conditioning agents are compounds that alter the physical structure and/or physical characteristics of the surfactant paste when added to the paste. In the present invention the chemical conditioning agent is alkyl sulphate in powdered form. It has been found that the addition to the surfactant paste reduces the stickiness of the paste, increases its viscosity and increases its softening point. This allows for more paste to be added during the agglomeration process thus leading to higher active agglomerates, preferably between 40% and 60%, more preferably greater than 50%. This method of treating the surfactant paste can be performed batchwise and continuous, preferably continuously.

Alkyl sulphate powder is defined herein as any free-flowing powder, flakes, noodles or needles which comprises at least 80% by weight of alkyl sulphate. Useful powders are commercially available from Albright & Wilson, Hickson Manro and Sidobre Sinnova. Alternatively suitable powders may be prepared by sulphating an alcohol, followed by neutralisation with, for example aqueous sodium hydroxide, then drying in a suitable spray drying tower, wiped film evaporator or suitable dryer. Dry neutralisation methods may also be used, neutralising alkyl sulphuric acid with, for example powdered sodium carbonate.

In a preferred embodiment of the invention an extruder is used to condition the paste. The extruder is a versatile piece of equipment which enables two or more pastes and the alkyl sulphate powder to be mixed Process aids may also be used. Preferred process aids which may be mixed with the surfactant paste are starch, soap, fatty acids and polymers. Process aids and surfactant paste may be mixed prior to the extruder in, for example, a high shear mixer; or in the extruder itself.

THE PASTES

One or various aqueous pastes of the salts of anionic surfactants is preferred for use in the present invention, preferably the sodium salt of the anionic surfactant. In a preferred embodiment, the anionic surfactant is preferably as concentrated as possible, (that is, with the lowest possible moisture content that allows it to flow in the manner of a liquid) so that it can be pumped at temperatures at which it remains stable. While granulation using various pure or mixed surfactants is known, for the present invention to be of practical use in industry and to result in particles of adequate physical properties to be incorporated into granular detergents, an anionic surfactant must be part of the paste in a concentration of above 40%, preferably from 40–95%.

It is preferred that the moisture in the surfactant aqueous paste is as low as possible, while maintaining paste fluidity, since low moisture leads to a higher concentration of the surfactant in the finished particle. Preferably the paste contains between 5 and 40% water, more preferably between 5 and 30% water and most preferably between 5% and 20% water.

It is preferable to use high active surfactant pastes to minimize the total water level in the system during mixing, granulating and drying. Lower water levels allow for: (1) a higher active surfactant to builder ratio, e.g., 1:1; (2) higher levels of other liquids in the formula without causing dough or granular stickiness; (3) less cooling, due to higher allowable granulation temperatures; and (4) less granular drying to meet final moisture limits.

Two important parameters of the surfactant pastes which can affect the mixing and granulation step are the paste temperature and viscosity. Viscosity is a function, among others, of concentration and temperature, with a range in this application from about 5,000 cps to 10,000,000 cps. Preferably, the viscosity of the paste entering the system is from about 20,000 to about 100,000 cps. and more preferably from about 30,000 to about 70,000 cps. The viscosity of the paste of this invention is measured at a temperature of 70° C.

The paste can be introduced into the mixer at an initial temperature between its softening point (generally in the range of 40–60° C) and its degradation point (depending on the chemical nature of the paste, e.g. alkyl sulphate pastes tend to degrade above 75–85° C.). High temperatures reduce viscosity simplifying the pumping of the paste but result in lower active agglomerates. In the present invention, the activity of the agglomerates is maintained high due to the elimination of moisture.

The introduction of the paste into the mixer can be done in many ways, from simply pouring to high pressure pumping through small holes at the end of the pipe, before the entrance to the mixer. While all these ways are viable to manufacture agglomerates with good physical properties, it has been found that in a preferred embodiment of the present invention the extrusion of the paste results in a better distribution in the mixer which improves the yield of particles with the desired size. The use of high pumping pressures prior to the entrance in the mixer results in an increased activity in the final agglomerates. By combining both effects, and introducing the paste through holes (extrusion) small enough to allow the desired flow rate but that keep the pumping pressure to a maximum feasible in the system, highly advantageous results are achieved.

HIGH ACTIVE SURFACTANT PASTE

The activity of the aqueous surfactant paste is at least 40% and can go up to about 95%; preferred activities are: 50–80% and 65–75%. The balance of the paste is primarily water but can include a processing aid such as a nonionic surfactant. At the higher active concentrations, little or no builder is required for cold granulation of the paste. The resultant concentrated surfactant granules can be added to dry builders or powders or used in conventional agglomeration operations. The aqueous surfactant paste contains an organic surfactant selected from the group consisting of anionic, zwitterionic, ampholytic and cationic surfactants, and mixtures thereof. Anionic surfactants are preferred. Nonionic surfactants are used as secondary surfactants or processing aids and are not included herein as an "active" surfactant. Surfactants useful herein are listed in U.S. Pat. No. 3,664,961, Norris, issued May 23, 1972, and in U.S. Pat. No. 3,919,678, Laughlin et al., issued Dec. 30, 1975. Useful cationic surfactants also include those described in U.S. Pat. No. 4,222,905, Cockrell, issued Sep. 16, 1980, and in U.S. Pat. No. 4,239,659, Murphy, issued Dec. 16, 1980. However, cationic surfactants are generally less compatible with the aluminosilicate materials herein, and thus are preferably used at low levels, if at all, in the present compositions. The following are representative examples of surfactants useful in the present compositions.

Water-soluble salts of the higher fatty acids, i.e., "soaps", are useful anionic surfactants in the compositions herein. This includes alkali metal soaps such as the sodium, potassium, ammonium, and alkylammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkyl benzene sulfonates in which the alkyl group contains from about 9 to about 15 carbon atoms, in straight or branched chain configuration, e.g., those of the type described in U.S. Pat. Nos. 2,220,099 and 2,477,383. Especially valuable are linear straight chain alkyl benzene sulfonates in which the average number of carbon atoms in the alkyl group is from about 11 to 13, abbreviated as $C_{11}$–$C_{13}$ LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing from about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; watersoluble salts of olefin sulfonates containing from about 12 to 24 carbon atoms; and beta-alkyloxy alkane sulfonates containing from about 1 to 3 carbon atoms in the alkyl group and from about 8 to about 20 carbon atoms in the alkane moiety. Although the acid salts are typically discussed and used, the acid neutralization cam be performed as part of the fine dispersion mixing step.

The preferred anionic surfactant pastes are mixtures of linear or branched alkylbenzene sulfonates having an alkyl of 10–16 carbon atoms and alkyl sulfates having an alkyl of 10–18 carbon atoms. These pastes are usually produced by reacting a liquid organic material with sulfur trioxide to produce a sulfonic or sulfuric acid and then neutralizing the acid to produce a salt of that acid. The salt is the surfactant paste discussed throughout this document. The sodium salt is preferred due to end performance benefits and cost of NaOH vs. other neutralizing agents, but is not required as other agents such as KOH may be used.

Water-soluble nonionic surfactants are also useful as secondary surfactant in the compositions of the invention. Indeed, preferred processes use anionic/nonionic blends. A particularly preferred paste comprises a blend of nonionic and anionic surfactants having a ratio of from about 0.01:1 to about 1:1, more preferably about 0.05:1. Nonionics can be used up to an equal amount of the primary organic surfactant. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 16 carbon atoms, in either a straight chain or branched chain configuration, with from about 4 to 25 moles of ethylene oxide per mole of alkyl phenol.

Preferred nonionics are the water-soluble condensation products of aliphatic alcohols containing from 8 to 22 carbon atoms, in either straight chain or branched configuration, with from 4 to 25 moles of ethylene oxide per more of alcohol. Particularly preferred are the condensation products of alcohols having an alkyl group containing from about 9 to 15 carbon atoms with from about 4 to 25 moles of ethylene oxide per mole of alcohol; and condensation products of propylene glycol with ethylene oxide.

Semi-polar nonionic surfactants include water-soluble amine oxides containing one alkyl moiety of from about 10 to 18 carbon atoms and 2 moieties selected from the group consisting of alkyl groups and hydroxyalkyl groups containing from 1 to about 3 carbon atoms; water-soluble phosphine oxides containing one alkyl moiety of about 10 to 18 carbon atoms and 2 moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be either straight or branched chain and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium phosphonium, and sulfonium compounds in which one of the aliphatic substituents contains from about 8 to 18 carbon atoms.

Particularly preferred surfactants herein include linear alkylbenzene sulfonates containing from about 11 to 14 carbon atoms in the alkyl group; tallow alkyl sulfates; coconutalkyl glyceryl ether sulfonates; alkyl ether sulfates wherein the alkyl moiety contains from about 14 to 18 carbon atoms and wherein the average degree of ethoxylation is from about 1 to 4; olefin or paraffin sulfonates containing from about 14 to 16 carbon atoms; alkyldimethylamine oxides wherein the alkyl group contains from about 11 to 16 carbon atoms; alkyldimethylammonio propane sulfonates and alkyldimethylammonio hydroxy propane sulfonates wherein the alkyl group contains from about 14 to 18 carbon atoms; soaps of higher fatty acids containing from about 12 to 18 carbon atoms; condensation products of C9–C15 alcohols with from about 3 to 8 moles of ethylene oxide, and mixtures thereof.

Useful cationic surfactants include. Useful cationic surfactants include water-soluble quaternary ammonium compounds of the form $R_4R_5R_6R_7N^+X^-$, wherein $R_4$ is alkyl having from 10 to 20, preferably from 12–18 carbon atoms, and $R_5$, $R_6$ and $R_7$ are each $C_1$, to $C_7$ alkyl preferably methyl; $X^-$is an anion, e.g. chloride. Examples of such trimethyl ammonium compounds include $C_{12-14}$ alkyl trimethyl ammonium chloride and cocalkyl trimethyl ammonium methosulfate.

Specific preferred surfactants for use herein include: sodium linear $C_{11}$–$C_{13}$ alkylbenzene sulfonate; α-olefin sulphonates; triethanolammonium $C_{11}$–$C_{13}$ alkylbenzene sulfonate; alkyl sulfates, (tallow, coconut, palm, synthetic origins, e.g. $C_{45}$, etc.); sodium alkyl sulfates; MES; sodium coconut alkyl glyceryl ether sulfonate; the sodium salt of a sulfated condensation product of a tallow alcohol with about 4 moles of ethylene oxide; the condensation product of a coconut fatty alcohol with about 6 moles of ethylene oxide; the condensation product of tallow fatty alcohol with about 11 moles of ethylene oxide; the condensation of a fatty alcohol containing from about 14 to about 15 carbon atoms with about 7 moles of ethylene oxide; the condensation product of a $C_{12}$–$C_{13}$ fatty alcohol with about 3 moles of ethylene oxide; 3-(N,N-dimethyl-N-coconutalkylammonio)-2-hydroxypropane-1-sulfonate; 3-(N,N-dimethyl-N-coconutalkylammonio)-propane-1-sulfonate; 6- (N-dodecylbenzyl-N,N-dimethylammonio) hexanoate; dodecyldimethylamine oxide; coconutalkyldimethylamine oxide; and the water-soluble sodium and potassium salts of coconut and tallow fatty acids.

(As used herein, the term "surfactant" means non-nonionic surfactants, unless otherwise specified. The ratio of the surfactant active (excluding the nonionic(s)) to dry detergent builder or powder ranges from 0.005 to 19:1, preferably from 0.05 to 10:1, and more preferably from 0.1:1 to 5:1. Even more preferred said surfactant active to builder ratios are 0.15:1 to 1:1; and 0.2:1 to 0.5:1).

The Extruder

The extruder fulfils the functions of pumping and mixing the viscous surfactant paste on a continuous basis. A basic extruder consists of a barrel with a smooth inner cylindrical surface. Mounted within this barrel is the extruder screw. There is an inlet port for the high active paste which, when the screw is rotated, causes the paste to be moved along the length of the barrel. The detailed design of the extruder allows various functions to be carried out. Firstly additional ports in the barrel may allow other ingredients, including the alkyl sulphate powder to be added directly into the barrel. Secondly means for heating or cooling may be installed in the wall of the barrel for temperature control. Thirdly, careful design of the extruder screw promotes mixing of the paste both with itself and with other additives. A preferred extruder is the twin screw extruder. This type of extruder has two screws mounted in parallel within the same barrel, which are made to rotate either in the same direction (co-rotation) or in opposite directions (counter-rotation). The co-rotating twin screw extruder is the most preferred piece of equipment for use in this invention.

Suitable twin screw extruders for use in the present invention include those supplied by : APV Bakes, (CP series); Werner and Pfleiderer, (Continua Series); Wenger, (TF Series); Leistritz, (ZSE Series); and Buss, (LR Series).

The Fine Dispersion Mixing and Granulation

The term "fine dispersion mixing and/or granulation," as used herein, means mixing and/or granulation of the above mixture in a fine dispersion mixer at a blade tip speed of from about 5m/sec. to about 50 m/sec., unless otherwise specified. The total residence time of the mixing and granulation process is preferably in the order of from 0.1 to 10 minutes, more preferably 0.1–5 and most preferably 0.2–4 minutes. The more preferred mixing and granulation tip speeds are about 10–45 m/sec. and about 15–40 m/sec.

Any apparatus, plants or units suitable for the processing of surfactants can be used for carrying out the process according to the invention. Suitable apparatus includes, for example, falling film sulphonating reactors, digestion tanks, esterification reactors, etc. For mixing/agglomeration any of a number of mixers/agglomerators can be used. In one preferred embodiment, the process of the invention is continuously carried out. Especially preferred are mixers of the Fukae$^R$ FS-G series manufactured by Fukae Powtech Kogyo Co., Japan; this apparatus is essentially in the form of a bowl-shaped vessel accessible via a top port, provided near its base with a stirrer having a substantially vertical axis, and a cutter positioned on a side wall. The stirrer and cutter may be operated independently of one another and at separately variable speeds. The vessel can be fitted with a cooling jacket or, if necessary, a cryogenic unit.

Other similar mixers found to be suitable for use in the process of the invention inlcude Diosna$^R$ V series ex Dierks & Söhne, Germany; and the Pharma Matrix$^R$ ex T K Fielder Ltd., England. Other mixers believed to be suitable for use in the process of the invention are the Fuji$^R$ VG-C series ex Fuji Sangyo Co., Japan; and the Roto$^R$ ex Zanchetta & Co srl, Italy.

Other preferred suitable equipment can include Eirich$^R$, series RV, manufactured by Gustau Eirich Hardheim, Germany; Lödige$^R$, series FM for batch mixing, series Baud KM for continuous mixing/agglomeration, manufactured by L ödige Machinenbau GmbH, Paderborn Germany; Drais$^R$ T160 series, manufactured by Drais Werke GmbH, Mannheim Germany; and Winkworth$^R$ RT 25 series, manufactured by Winkworth Machinery Ltd., Bershire, England.

The Littleford Mixer, Model #FM-130-D-12, with internal chopping blades and the Cuisinart Food Processor, Model #DCX-Plus, with 7.75 inch (19.7 cm) blades are two examples of suitable mixers. Any other mixer with fine dispersion mixing and granulation capability and having a residence time in the order of 0.1 to 10 minutes can be used. The "turbine-type" impeller mixer, having several blades on an axis of rotation, is preferred. The invention can be practiced as a batch or a continuous process.

Operating Temperatures

Preferred operating temperatures should also be as low as possible since this leads to a higher surfactant concentration in the finished particle. Preferably the temperature during the agglomeration is less than 100° C., more preferably between 25 and 90° C., and most preferably between 30 and 80° C.

Final Agglomerate Composition

The present invention produces granules of high density for use in detergent compositions. A preferred composition of the final agglomerate for incorporation into granular detergents has a high surfactant concentration. By increasing the concentration of surfactant, the particles/agglomerates made by the present invention are more suitable for a variety of different formulations. These high surfactants containing particle agglomerates require fewer finishing techniques to reach the final agglomerates, thus freeing up large amounts of processing aids (inorganic powders, etc.) that can be used in other processing steps of the overall detergent manufacturing process (spray drying, dusting off, etc).

The granules made according to the present invention are large, low dust and free flowing, and preferably have a bulk density of from about 0.4 to about 1.2 g/cc, more preferably from about 0.6 to about 0.8 g/cc. The weight average particle size of the particles of this invention are from about 200 to about 1000 microns. The preferred granules so formed have a particle size range of from 200 to 2000 microns. The more preferred granulation temperatures range from about 25° C. to about 60° C., and most preferably from about 30° C. to about 50° C.

Drying

The desired moisture content of the free flowing granules of this invention can be adjusted to levels adequate for the intended application by drying in conventional powder drying equipment such as fluid bed dryers. If a hot air fluid bed dryer is used, care must be exercised to avoid degradation of heat sensitive components of the granules. It is also advantageous to have a cooling step prior to large scale storage. This step can also be done in a conventional fluid bed operated with cool air. The drying/cooling of the agglomerates can also be done in any other equipment suitable for powder drying such as rotary dryers, etc.

For detergent applications, the final moisture of the agglomerates needs to be maintained below levels at which the agglomerates can be stored and transported in bulk. The exact moisture level depends on the composition of the agglomerate but is typically achieved at levels of 1–8% free water (i.e. water not associated to any crystalline species in the agglomerate) and most typically at 2–4%.

Detergency Builders and Powders

Any compatible detergency builder or combination of builders or powder can be used in the process and compositions of the present invention.

The detergent compositions herein can contain crystalline aluminosilicate ion exchange material of the formula $$Na_z[(AlO_2)_z.(SiO_2)y].xH_2O$$

wherein z and y are at least about 6, the molar ratio of z to y is from about 1.0 to about 0.4 and z is from about 10 to about 264. Amorphous hydrated aluminosilicate materials useful herein have the empirical formula $$M_z(zAlO_2.ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate. Hydrated sodium Zeolite A with a particle size of from about 1 to 10 microns is preferred.

The aluminosilicate ion exchange builder materials herein are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameters" herein represents the average particle size diameter by weight of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is at least about 200 mg equivalent of $CaCO_3$ water hardness/g of aluminosilicate, calculated on an anhydrous basis, and which generally is in the range of from about 300 mg eq./g to about 352 mg eq./g. The aluminosilicate ion exchange materials herein are still further characterized by their calcium ion exchange rate which is at least about 2 grains $Ca^{++}$/gallon/minute/gram/gallon of aluminosilicate (anhydrous basis), and generally lies within the range of from about 2 grains/gallon/minute/gram/gallon to about 6 grains/gallon/minute/gram/gallon, based on calcium ion hardness. Optimum aluminosilicate for builder purposes exhibit a calcium ion exchange rate of at least about 4 grains/gallon/minute/gram/gallon.

The amorphous aluminosilicate ion exchange materials usually have a $Mg^{++}$ exchange of at least about 50 mg eq. $CaCO_3$/g (12 mg $Mg^{++}$/g) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally occurring aluminosilicates or synthetically derived. A method for producing aluminosilicate ion exchange materials is discussed in U.S. Pat. No. 3,985,669, Krummel et al., issued Oct. 12, 1976, incorporated herein by reference. Preferred synthetic crystalline aluminosilicate ion exchange materials useful herein are available under the designations Zeolite A, Zeolite B, Zeolite X and Zeolite P. In an especially preferred embodiment, the crystalline aluminosilicate ion exchange material has the formula $$Na_{12}[(AlO_2)_{12}(SiO2)_{12}].XH_2O$$

wherein x is from about 20 to about 30, especially about 27 and has a particle size generally less than about 5 microns.

The granular detergents of the present invention can contain neutral or alkaline salts which have a pH in solution of seven or greater, and can be either organic or inorganic in nature. The builder salt assists in providing the desired density and bulk to the detergent granules herein. While some of the salts are inert, many of them also function as detergency builder materials in the laundering solution.

Examples of neutral water-soluble salts include the alkali metal, ammonium or substituted ammonium chlorides, fluorides and sulfates. The alkali metal, and especially sodium, salts of the above are preferred. Sodium sulfate is typically used in detergent granules and is a particularly preferred salt. Citric acid and, in general, any other organic or inorganic acid may be incorporated into the granular detergents of the present invention as long as it is chemically compatible with the rest of the agglomerate composition.

Other useful water-soluble salts include the compounds commonly known as detergent builder materials. Builders are generally selected from the various water-soluble, alkali metal, ammonium or substituted ammonium phosphates, polyphosphates, phosphonates, polyphosphonates, carbonates, silicates, borates, and polyhyroxysulfonates. Preferred are the alkali metal, especially sodium, salts of the above.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, incorporated herein by reference.

Examples of nonphosphorus, inorganic builders are sodium and potassium carbonate, bicarbonate, sesquicarbonate, tetraborate decahydrate, and silicate having a molar ratio of $SiO_2$ to alkali metal oxide of from about 0.5 to about 4.0, preferably from about 1.0 to about 2.4. The compositions made by the process of the present invention does not require excess carbonate for processing, and preferably does not contain over 2% finely divided calcium carbonate as disclosed in U.S. Pat. No. 4,196,093, Clarke et al., issued Apr. 1, 1980, and is preferably free of the latter.

As mentioned above powders normally used in detergents such as zeolite, carbonate, silica, silicate, citrate, phosphate, perborate, etc. and process aids such as starch, soap or fatty acid can be used in preferred embodiments of the present invention.

Polymers

Also useful are various organic polymers, some of which also may function as builders to improve detergency. Included among such polymers may be mentioned sodium carboxy-lower alkyl celluloses, sodium lower alkyl celluloses and sodium hydroxy-lower alkyl celluloses, such as sodium carboxymethyl cellulose, sodium methyl cellulose and sodium hydroxypropyl cellulose, polyvinyl alcohols (which often also include some polyvinyl acetate), polyacrylamides, polyacrylates and various copolymers, such as those of maleic and acrylic acids. Molecular weights for such polymers vary widely but most are within the range of 2,000 to 100,000.

Polymeric polycarboxyate builders are set forth in U.S. Pat. No. 3,308,067, Diehl, issued Mar. 7, 1967. Such materials include the water-soluble salts of homo-and copolymers of aliphatic carboxylic acids such as maleic acid, itaconic acid, mesaconic acid, fumaric acid, aconitic acid, citraconic acid and methylenemalonic acid.

Optionals

Other ingredients commonly used in detergent compositions can be included in the compositions of the present invention. These include flow aids, color speckles, bleaching agents and bleach activators, suds boosters or suds suppressors, antitarnish and anticorrosion agents, soil suspending agents, soil release agents, dyes, fillers, optical brighteners, germicides, pH adjusting agents, nonbuilder alkalinity sources, hydrotropes, enzymes, enzyme-stabilizing agents, chelating agents, perfumes, soap and fatty acid.

EXAMPLES

In the following examples all percantages are by weight unless otherwise stated:

AS/AE3S paste is a 78% aqueous solution of alkyl sulphate and alkyl ether sulphate (with 3 EO groups per molecule) comprising 4 parts of alkyl sulphate to 1 part of alkyl ether sulphate.

LAS paste is a 78% active aqueous solution of sodium linear alkyl benzene sulphonate AS powder comprises 95% active powder Polyacrylate powder comprises co-polymer of acrylic and maliec acid Silicate powder comprises 80% sodium silicate and is produced by spray-drying

| | Ex. 1 | Ex. 2 | Comparative Ex. 3 |
|---|---|---|---|
| AS/AE3S Paste | 16 | 32 | 38 |
| LAS paste | 20 | — | — |
| Alkyl sulphate powder | 4 | 18 | — |
| Polyacrylate polymer | — | 7 | 17 |
| Sodium carbonate | 20 | 20 | 12 |
| Zeolite A | 29 | 15 | 22 |
| Silicate powder | 1 | — | — |
| Water/Misc. minors | 10 | 8 | 11 |

In each of examples 1 to 3 the AE3S/AS paste, and the LAS paste when present, were fed into a continuous twin-screw extruder. The alkyl sulphate powder, or the polyacrylate polymer, and silicate when present, were added directly to into the barrel of the extruder through an inlet port. The mixture was then extruded through a die directly into a high shear mixer (Loedig® CB) where is mixed with powder streams comprising the sodium carbonate and the zeolite. The resulting product was then passed to a medium shear mixer (Loedig® KM) resulting in a free-flowing detergent product in the form of agglomerates.

The bulk density of the product from each of the examples was between 680 and 700 g/l.

AS/NI paste is a 95% aqueous solution of alkyl sulphate and alcohol ethoxylate (with 3 EO groups per molecule) comprising 2 parts of alkyl sulphate to 1 part of alcohol ethoxylate.

LAS/NI paste is a 95% active aqueous solution of sodium linear alkyl benzene sulphonate and alcohol ethoxylate (with 3 EO groups per molecule) comprising 2 parts of LAS to 1 part of alcohol ethoxylate.

| | Ex. 4 | Ex. 5 | Comparative Ex. 6 |
|---|---|---|---|
| AS/NI Paste | 30 | — | 30 |
| LAS/NI paste | — | 30 | — |

-continued

| | Ex. 4 | Ex. 5 | Comparative Ex. 6 |
|---|---|---|---|
| Alkyl sulphate powder | 20 | 20 | — |
| Zeolite MAP | 35 | 35 | 55 |
| Sodium citrate | 5 | 5 | 5 |
| Water/Misc. minors | 10 | 10 | 10 |

In each of examples 4 and 5 the AS/NI paste, or the LAS/NI paste, was fed into a continuous twin-screw extruder. The alkyl sulphate powder was added directly to into the barrel of the extruder through an inlet port. The mixture was then extruded through a die directly into a high shear mixer (Loedig® CB) where is mixed with powder streams comprising the sodium citrate and the zeolite. The resulting product was then passed to a medium shear mixer (Loedig® KM) resulting in a free-flowing detergent product in the form of agglomerates.

In comparative example 6 the AS/NI paste was fed diectly into the high shear mixer.

The bulk density of the product from each of the examples was between 680 and 700 g/l.

What is claimed is:

1. A process for making a granular detergent component or composition comprising the steps of:

(i) forming a neutral or alkaline paste comprising at least 40% by weight of anionic surfactant;

(ii) mixing in an extruder a first powder with the surfactant paste in a ratio of at least 1 part powder to 100 parts paste, and whereby the mixing step increases the viscosity of the surfactant paste; wherein the first powder comprises at least 80% by weight of alkyl sulphate;

(iii) forming the granular detergent component or composition by mixing the high viscosity paste so-formed with builder powders sequentially in a high-shear mixer granulator having a tool tip-speed of from 5 to 50 m/sec and a medium speed agglomerator, wherein the ratio of high viscosity paste to builder powder is from 9:1 to 1:5.

2. A process according to claim 1 wherein the alkyl sulphate powder comprises less than 5% by weight of water.

3. A process according to claim 1 wherein the granular detergent component or composition has a bulk density of at least 0.6 g/cc and comprises anionic surfactant at a level of between 40% and 60% by weight of the component or composition.

4. A process according to claim 1 wherein the builder powder consists essentially of builders selected from the group consisting of carbonate, aluminosilicate, silicate, and mixtures thereof.

5. A process according to claim 1 wherein the surfactant paste is mixed with a process aid selected from the group consisting of starch, soap, fatty acid, polymer, or mixtures thereof.

6. A process according to claim 5 wherein the surfactant paste and process aid are mixed either between steps (i) and (ii), or in step (ii).

* * * * *